US005608297A

United States Patent [19]

Goebel

[11] Patent Number: 5,608,297

[45] Date of Patent: Mar. 4, 1997

[54] PLASMA SWITCH AND SWITCHING METHOD WITH FAULT CURRENT INTERRUPTION

[75] Inventor: Dan M. Goebel, Tarzana, Calif.

[73] Assignee: Hughes Electronics, Los Angeles, Calif.

[21] Appl. No.: 364,357

[22] Filed: Dec. 27, 1994

[51] Int. Cl.[6] ..... H01J 17/14

[52] U.S. Cl. ..... 315/344; 315/111.41; 315/338; 361/5; 313/156; 313/161; 313/162; 313/231.41

[58] Field of Search ..... 313/231.31, 359.1, 313/360.1, 161, 162, 156, 157, 158, 231.41; 315/344, 348, 111.41, 111.21, 338; 361/3, 4, 5, 6, 7

[56] References Cited

U.S. PATENT DOCUMENTS

| | | | |
|---|---|---|---|
| 3,678,289 | 7/1972 | Lutz | 307/149 |
| 3,749,978 | 7/1973 | Gallagher | 315/236 |
| 3,873,871 | 3/1975 | Hofmann | 313/157 |
| 4,071,801 | 1/1978 | Harvey | 315/154 |
| 4,088,929 | 5/1978 | Wheldon | 315/347 |
| 4,247,804 | 1/1981 | Harvey | 315/344 |
| 4,596,945 | 6/1986 | Schumacher et al. | 315/344 |
| 5,019,752 | 5/1991 | Schumacher | 315/344 |
| 5,212,425 | 5/1993 | Goebel et al. | 315/111.21 |

OTHER PUBLICATIONS

A. Guenther, et al., ed. *Opening Switches,* Plenum Publishing Corp., New York, 1987, pp. 93–129.

Dan M. Goebel, "High Power Modulator for Plasma Ion Implantation", *Journal Vacuum Science Technology B.* vol. 12, No. 2, Mar./Apr. 1994, pp. 838–842.

Dan M. Goebel, et al., "Low Voltage Drop Plasma Switch", *Review Scientific Instruments,* vol. 64, No. 8, Aug. 1993, pp. 2312–2319.

Dan M. Goebel, "Ion Source Dischare Performance and Stability", *Phisics of Fluids,* vol. 25, No. 6, Jun. 1982, pp. 1093–1102.

Dan M. Goebel, et al., "Recent Advantages in Crossatron Switches", *IEEE Pulsed–Power Conference,* Albuquerque, New Mexico, Jun. 1993.

*Primary Examiner*—Robert Pascal
*Assistant Examiner*—Arnold Kinkead
*Attorney, Agent, or Firm*—Vijayalakshimi D. Duraiswamy; Wanda K. Denson-Low

[57] ABSTRACT

A plasma switch is provided which can limit fault currents to a range that is elecrostatically interruptible by a control grid. The switch includes magnets that generate a first magnetic vector which cooperates with an electric field to generate a plasma, the density of which is a function of the magnitude of the first magnetic vector. A stalling coil is arranged to generate a second magnetic vector that opposes and cancels a portion of the first magnetic vector in response to a fault current through the switch. This establishes a stalling condition in which the plasma density falls and a plasma potential gradient is set up in the switch. In this unstable condition, the plasma current is interruptible by the control grid.

12 Claims, 4 Drawing Sheets

PLASMA SWITCH AND SWITCHING METHOD WITH FAULT CURRENT INTERRUPTION

BACKGROUND OF THE INVENTION

1. Field of the Invention

The present invention relates generally to high-current switches and more particularly to crossed-field plasma switches and associated switching methods.

2. Description of the Related Art

High-current switches are described in *Opening Switches*, Plenum Publishing Corp., New York, 1987, edited by A. Guenther, et al. In particular, a chapter, written by Robert W. Schumacher and Robin J. Harvey and entitled "Low-Pressure Plasma Opening Switches", describes two examples of high-current plasma switches.

The first is the crossed-field tube (XFT). XFTs are low-pressure plasma-switch devices which change the magnitude of a magnetic field to control conduction. Their structure generally includes a cylindrical anode and a surrounding cylindrical cathode. An electromagnet is typically wound in intimate contact with the cathode outer surface and the interelectrode gap is filled with a low-pressure gas.

In operation, voltage is applied across the electrodes to establish a radial electric field E. Current is applied to the electromagnet to generate an axial magnetic field B that is nearly uniform in the switch volume. In this crossed-field geometry, the electrons in the interelectrode gap move along a substantially circumferential path where they collide with gas atoms to produce secondary electrons and ions. The length of this path causes a sufficiently large number of collisions to ignite and maintain a plasma. Removing the magnetic field B causes the electrons to move along a radial path between the electrodes. Because this radial path length is too short to produce significant numbers of secondary electrons, the plasma then dissipates. The switch opening is delayed by the time it takes for the magnetic field to fall throughout the entire switch volume and for the residual plasma to flow to the containment walls. This delay is further increased because of local eddy currents in the walls.

A basic XFT embodiment was described in U.S. Pat. No. 3,678,289, which issued Jul. 18, 1972 to Michael A. Lutz, et al. and was assigned to Hughes Aircraft Company, the assignee of the present invention. In this XFT, a permanent magnet produces an axial magnetic field. A second, switchable electromagnet is arranged to generate a pulsed magnetic field that axially opposes ("bucks") the permanent field. The reduction in the magnetic field opens the switch.

XFT arcing problems were addressed in U.S. Pat. No. 3,749,978, which issued Jul. 31, 1973 to Hayden E. Gallagher and was assigned to Hughes Aircraft Company. This patent discloses that arcing problems can be reduced if the net magnetic field is maintained beneath the critical value for a sufficiently long time duration.

A specific bucking coil embodiment is disclosed in U.S. Pat. No. 3,873,871, which issued Mar. 25, 1975 to Gunter A. G. Hofmann and was assigned to Hughes Aircraft Company. This patent shows a short circuit coil associated with the bucking coil and the permanent field coil to reduce inductive coupling.

Another bucking coil embodiment is shown in U.S. Pat. No. 4,071,801, which issued Jan. 31, 1978 to Robin J. Harvey and was assigned to Hughes Aircraft Company. In this patent, a bucking coil is oriented orthogonally with both the electric field and the main magnetic field to reduce the energy required to develop the opposing field.

XFTs can carry and interrupt very large currents, e.g., >1000 amperes. However, their interrupt time is rather long, e.g., 10 microseconds. Since the main field can be quite strong, e.g., >100 gauss, a substantial bucking field pulse is required to bring the net field strength below the critical value for ionization. Coils to produce large pulsed fields have substantial inductance; consequently, current pulses through them have slow rise and fall times.

A second plasma switch example is the CROSSATRON Modulator Switch (CMS) (CROSSATRON is a trademark of Hughes Aircraft Company). The CMS uses a low-pressure, crossed-field discharge to generate a high-density plasma for conducting high currents with low forward drop across the switch.

The CMS typically has two grids, a source grid and a control grid. These grids are usually cylindrically shaped and coaxially arranged with the cathode and anode. They are positioned between the cathode and anode with the source grid adjacent the cathode. Magnets are positioned around the cathode to establish a magnetic field B that is preferably limited to the gap between the cathode and the source grid. The CMS controls the conduction of electrons to the anode by controlling the potential of the control grid. Therefore, the CMS controls current by the application of an electric field while the XFT controls current by the application of a magnetic field.

The basic structure of the CMS is described in U.S. Pat. No. 4,247,804, which issued Jan. 27, 1981 to Robin J. Harvey and was assigned to Hughes Aircraft Company.

Methods and structure directed to controlling a CMS were disclosed in U.S. Pat. No. 4,596,945, which issued Jun. 24, 1986 to Robert W. Schumacher, et al., and was assigned to Hughes Aircraft Company. This patent found that successful current interruption in a CMS depends upon the use of low gas pressure and upon the physics of the control grid-plasma interface.

An improved cold cathode structure was disclosed in U.S. Pat. No. 5,019,752, which issued May 28, 1991 to Robert W. Schumacher and was assigned to Hughes Aircraft Company. Generation of secondary electrons was enhanced by a cathode configured with a series of perturbations.

CMSs have been constructed that are capable of holding off voltages up to 100 kV and of interrupting currents up to 1000 Amperes. However, all CMSs can conduct more current than they can interrupt. Consequently, a fault condition in a CMS-based switching system may cause the CMS current to overwhelm the capability of its control grid to interrupt the current. At best, this requires restarting the system; at worst, the system or parts being processed by the system are damaged.

For example, an exemplary ion-implantation system is configured to deliver negative, high-voltage pulses to a part that is immersed in a plasma field. Ions in the plasma are accelerated toward and implanted into the part. However, the part's surface condition sometimes causes an arc which reduces the circuit load. The CMS cannot interrupt the resulting high current; as a consequence, stored energy in the system is dumped and the part is severely damaged. Because the system conduction path will conduct significant current within 10 microseconds, preventing parts damage would require the ability to interrupt fault currents in less than 5 microseconds.

SUMMARY OF THE INVENTION

The present invention is directed to a cold-cathode, crossed field plasma switch and switching method that can interrupt as much current as it can conduct with an interruption time that is sufficient to prevent system damage. This goal is realized by the recognition that the switch current can be brought within the range of fast electrostatic blocking by canceling only a portion of the switch's magnetic field to create an unstable stalling condition. In this condition, the plasma density is reduced and a plasma potential gradient is created. The cancelation can be accomplished with a small opposing field which can be generated quickly because of its limited strength. Therefore, this recognition makes it possible to realize a plasma switch structure which can interrupt large currents before they damage systems that incorporate the switch.

A plasma switch in accordance with the invention includes a plasma generator in which a first magnetic field and an electric field are oriented so that a change in the first magnetic field strength alters the density of a plasma; a first electrode configured to sustain a voltage potential between it and the plasma generator; a second electrode positioned between the plasma generator and the first electrode, the second electrode configured to respond to a first signal by initiating a plasma current between the plasma generator and the first electrode and to respond to a second control signal by interrupting the plasma current when it is within a predetermined range; and a magnetic field generator arranged to generate, in response to a fault signal, a second magnetic field that reduces the plasma current to that range by canceling a portion of the first magnetic field.

In a switch embodiment, the plasma generator includes a cylindrical cathode and a coaxially arranged source grid and the second magnetic field generator comprises a coil arranged around the perimeter of the cathode. In this embodiment, the first and second electrodes are also cylindrical and coaxially arranged with the cathode.

The novel features of the invention are set forth with particularity in the appended claims. The invention will be best understood from the following description when read in conjunction with the accompanying drawings.

DESCRIPTION OF THE PREFERRED EMBODIMENTS

Paschen breakdown is the term usually used to describe a diffuse, glow discharge through a gas that is positioned between two high-voltage electrodes. Under Paschen breakdown conditions, enough electrons collide with gas atoms or molecules to form a mixture of free secondary electrons and gas ions. This mixture is a plasma, i.e., a gas that is sufficiently ionized to be electrically conductive and to be affected by magnetic fields.

Figure 1:
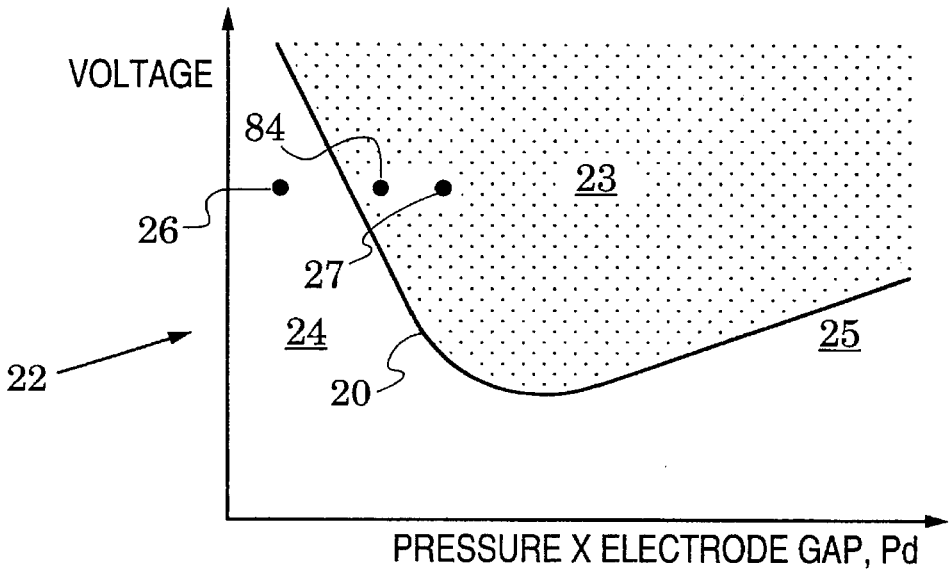
FIG. 1 is a graph that illustrates different switch operating points relative to the Paschen breakdown curve.

The graph 22 of FIG. 1 illustrates that the Paschen breakdown voltage 20 is a function of the product (Pd) of gas pressure and electrode spacing. Plasma generation occurs in the breakdown region 23 that is above the curve 20. For most gases, the breakdown curve 20 has a minimum at about 1 Torr-cm and rises sharply on the left-hand side of the curve where Pd is low. In the region 24 under the left-hand side of the curve 20, the mean electron path length between gas molecule collisions is long compared to the gap spacing so that stray electrons in the gas are collected at the electrodes before they can ignite a plasma. In the region 25 under the right-hand side of the curve 20, the mean electron path between collisions is so short that the electrons do not gain sufficient energy to cause ionization.

Since the breakdown voltage is a function of Pd, a gas-filled, high-voltage electrode gap operating on either side of the curve 22 forms the basis of an effective electrical switch. In practice, it is generally more effective to operate on the low-pressure side. There the electron-neutral collision rate is lower and the electron temperature is higher, which leads to a more rapid current interruption and a faster gap-voltage recovery time.

For example, if the gap is operated at the Pd position 26 to the left of the curve 22, high voltage can be held off across the electrodes without conduction. This represents an open switch operating position. If the gap is operated at the Pd position 27 to the right of the curve 22, Paschen breakdown is initiated and the ionized gas conducts current between the electrodes. This represents a closed switch operating position.

As described hereinbefore, the gap spacing is effectively changed in an XFT by the application of a magnetic field which deflects the electrons along a substantially circumferential path between the electrodes. Thus, applying the magnetic field places the cathode-anode gap of the XFT at the closed operation position 27 in FIG. 1, while removing the magnetic field moves it to the open operating position 26. In contrast, a voltage potential is applied and removed across the cathode-source grid gap of a CMS by grid biasing to move between these operating positions. Therefore, in a CMS the plasma is generated primarily in the cathode-source grid gap.

Figure 2:
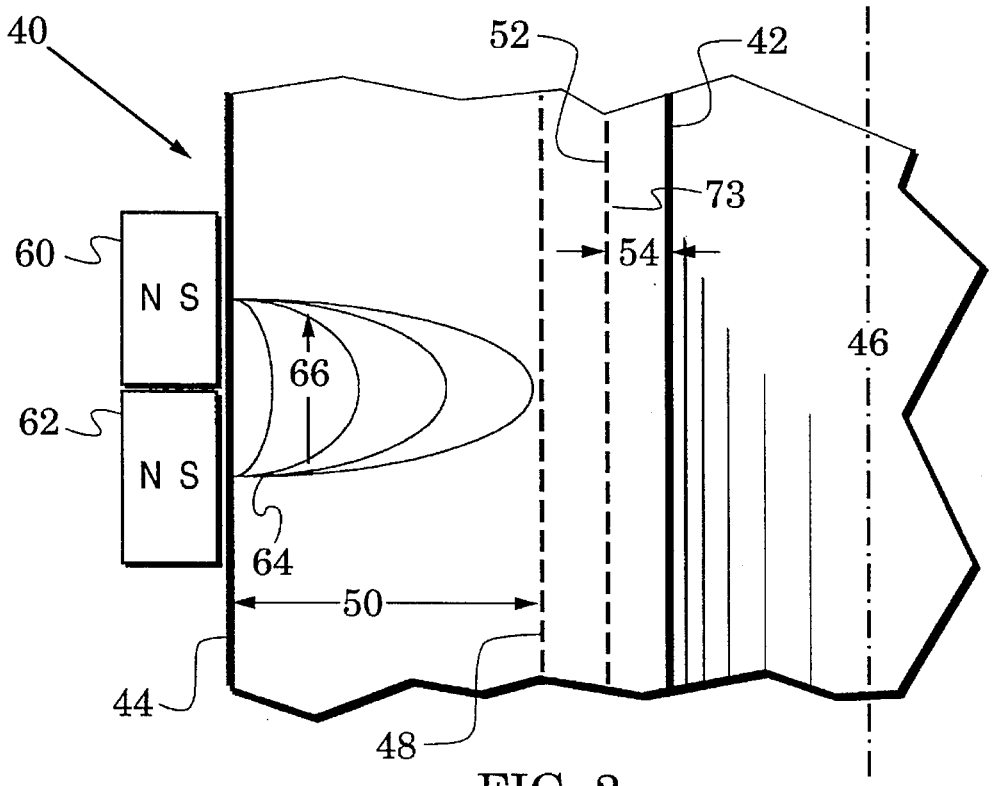
FIG. 2 (PRIOR ART)
FIG. 2 is a fragmentary sectional view illustrating an off-axis portion of a prior art Crossotron modulator switch.

An off-axis section of a prior art CMS 40 is illustrated in FIG. 2. The CMS 40 includes a cylindrical anode 42, and a cylindrical cathode 44 whose diameter is greater than that of the anode 42. These electrodes are arranged in a coaxial relationship about the CMS axis 46. Two cylindrical gridded electrodes (i.e., electrodes that each form a plurality of apertures) are arranged to also be coaxial with the axis 46. The first electrode is a source grid 48 that is spaced from the cathode 44 to form a cathode-source grid gap 50. The second is a control grid 52 that is spaced from the anode to form a control grid-anode gap 54.

Magnets 60, 62 are arranged circumferentially about the cathode 44 to generate a magnetic field 64 that is preferably controlled to lie only in the cathode-source grid gap 50. To facilitate this, the magnetic field 64 can be cusp-shaped as shown in FIG. 2. Specifically, the field 64 is configured to have an axial field component B represented by the field vector 66. Although the magnets 60, 62 can be electromagnets, they are preferably permanent magnets to reduce power usage.

The CMS 40 is typically filled with helium or hydrogen at a low pressure, e.g., approximately 100 mTorr. Positive voltage applied to the source grid 48 produces a radial electric field E in the cathode-source grid gap 50. This forms a crossed field in the gap 50. In response, electrons are deflected along a substantially circumferential path and a plasma is generated in the cathode-source grid gap 50. The cusp-shaped magnetic field 64 facilitates the localization of plasma generation to the cathode-source grid gap 50. Essentially, the source grid 48 acts as an anode which cooperates with the cathode 44 in the generation of a plasma source.

A positive pulse on the control grid 52 allows plasma flow between the cathode 44 and the anode 42, i.e., the CMS conducts current. A subsequent negative pulse on the control grid 52 interrupts the CMS current under normal operating conditions, e.g., in the absence of a load fault.

Figure 3A:
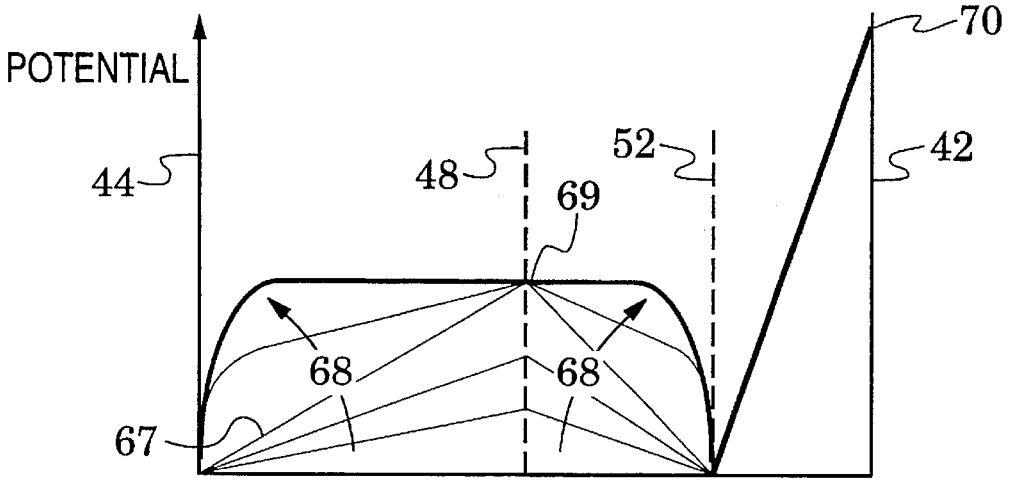
FIGS. 3A–3C are graphs that illustrate potential distribution across the switch of FIG. 2 during three operational stages of the switch.
Figure 3B:
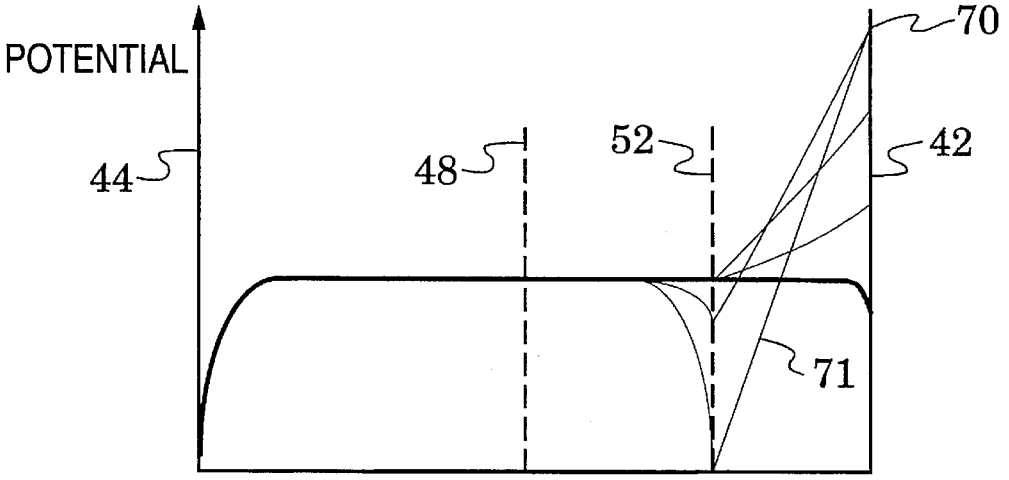
Figure 3C:
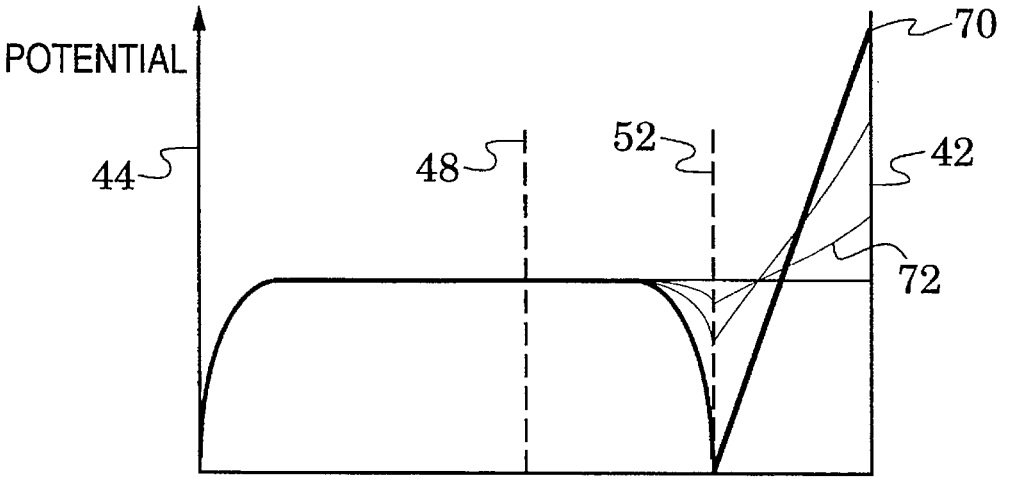

FIGS. 3A–3C illustrate switch potential distributions. These figures are oriented similarly to FIG. 2 with the cathode and anode represented by solid lines 44 and 42 at the left and right sides of each figure. The source grid and control grid are represented by broken lines 48 and 52.

In FIG. 3A, the source grid 48 is pulsed to a potential, e.g., >500 V, above the cathode for a few microseconds to establish the crossed-field discharge. A plasma is ignited and its potential rises, as indicated by intermediate potential lines 67 and arrows 68, to a plasma potential 69. When plasma equilibrium is reached, the potential of the source grid 48 is allowed to fall to the plasma potential (approximately 400 V in hydrogen).

As long as the control cathode 48 is held at the cathode potential or below, the switch remains open and the full power supply voltage 70 appears across the control grid-anode gap (54 in FIG. 2).

The CMS 40 is closed by releasing the control grid potential, or preferably, by pulsing it momentarily above the plasma potential. This allows the plasma to flow through the control grid to the anode. Plasma electrons are collected by the anode, placing the switch in its conducting mode. As indicated by intermediate potential lines 71 in FIG. 3B, the potential of the control grid 52 rises and the potential of the anode 42 falls until they are both approximately equal to the plasma potential as shown in FIG. 3B.

To open the CMS, the control grid 52 is pulsed to the cathode potential or, preferably, below the cathode potential. An ion-depleted sheath develops about the control grid 52. When this sheath expands to block the apertures in the control grid 52, the flow of ions to the control grid-anode gap 54 ceases. The now-isolated plasma in the control grid-anode gap dissipates, the anode current is interrupted and the anode potential rises back to the supply voltage 70 as indicated by intermediate potential lines 72 in FIG. 3C.

Successful off-switching is achieved in the CMS 40 because it operates with a low gas pressure and its magnetic field 64 is shaped so that the field magnitude in the control grid-anode gap 54 is low. As a result of the latter condition, electrons in the gap 54 travel along a substantially radial path to the anode 42. As indicated by the Paschen breakdown curve 22 of FIG. 1, a combination of low pressure and an effectively short gap places operation in the left-side region 24 of the curve. This means that ionization cannot occur in the gap 54 to sustain the plasma in the now isolated control grid-anode gap 54. With no ionization in the gap 54 to frustrate the isolation achieved by the negative potential on the control grid 52, off-switching is successfully completed.

Figure 4A:
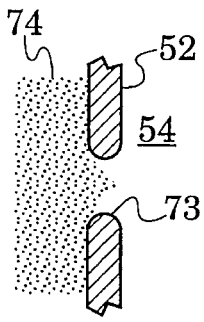
FIGS. 4A–E are fragmentary sectional views illustrating plasma-control grid relationships for five operational stages of the switch of FIG. 2.
Figure 4B:
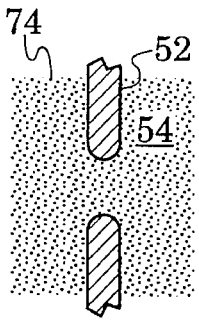

FIGS. 4A–4E illustrate the relationship between the plasma and the control grid 52 during the operational stages represented by FIGS. 3A–3C. FIGS. 4A–4E are directed to a single aperture 73 in the control grid 52. In FIG. 4A, the control grid 52 has just been pulsed to turn on the CMS. Plasma 74 is being drawn from its source in the cathode-source grid gap (50 in FIG. 2) by the cathode-anode potential. The plasma 74 is shown as it streams towards the control grid-anode gap 54. FIG. 4B illustrates the relationship during switch conduction, with plasma 74 filling the control grid-anode gap 54. At full current conduction, the anode voltage has fallen to the plasma potential as indicated in FIG. 3B.

Figure 4C:
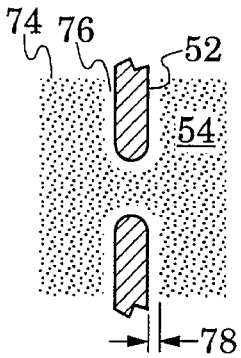

When the potential of the control grid 52 is pulsed below the plasma potential, ion current begins to flow to the control grid. Because of this, an ion-space-charge-limited sheath 76 develops about the control grid 52 as illustrated in FIG. 4C. The amplitude of the ion current depends upon the plasma density and temperature. The sheath thickness 78 is determined by the ion current density and the potential between the plasma 74 and the control grid 52 (specifically, the relationship is given by the Child-Langmuir law of $J=kV^{3/2}/\Delta x^2$ in which J=ion current density, V=plasma-control grid potential, $\Delta x$=the sheath thickness 78 and k is a constant that is determined by plasma permittivity, electron charge and ion mass).

Figure 4D:
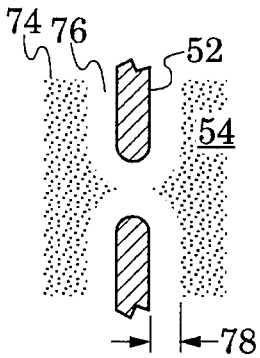
Figure 4E:
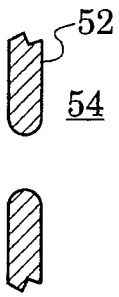

The sheath thickness 78 expands to its final dimension in FIG. 4D where it is greater than the radius of the grid aperture 73. Ions can no longer diffuse to the control grid-anode gap 54. The plasma 74 in the control grid-anode gap 54 is now isolated and switch closure proceeds as described hereinbefore. When the switch is fully closed, the plasma retreats to its source in the cathode-source grid gap 50 and, as indicated in FIG. 4E, there is no plasma adjacent the control grid 52.

FIGS. 4A–4E illustrate stages in the successful interruption of CMS current by electrostatic blocking, i.e., the application of sufficient control grid potential. However, the plasma current density between the cathode and anode can become unexpectably large, e.g., due to a fault that effectively bypasses a load circuit in series with the CMS. This causes an increase in the plasma current density in the aperture 73 of FIG. 4B. When a plasma-control grid potential is applied, the plasma current density may be so great that the thickness 78 of the control grid sheath 76 never exceeds the radius of the control grid apertures 73. The sheath 76 and control grid 52 remain in a relationship such as that shown in FIG. 4C.

In this case, the high plasma current density shields the plasma from the control grid and the switch current cannot be interrupted. That is, because the plasma source in the cathode-source grid gap (50 of FIG. 2) can supply a current greater than that which the control grid can interrupt, a system fault can cause the CMS to deliver a large, uncontrolled current. Although the high current generally does not damage the CMS 40, it can cause damage in a system that includes the CMS.

Figure 5:
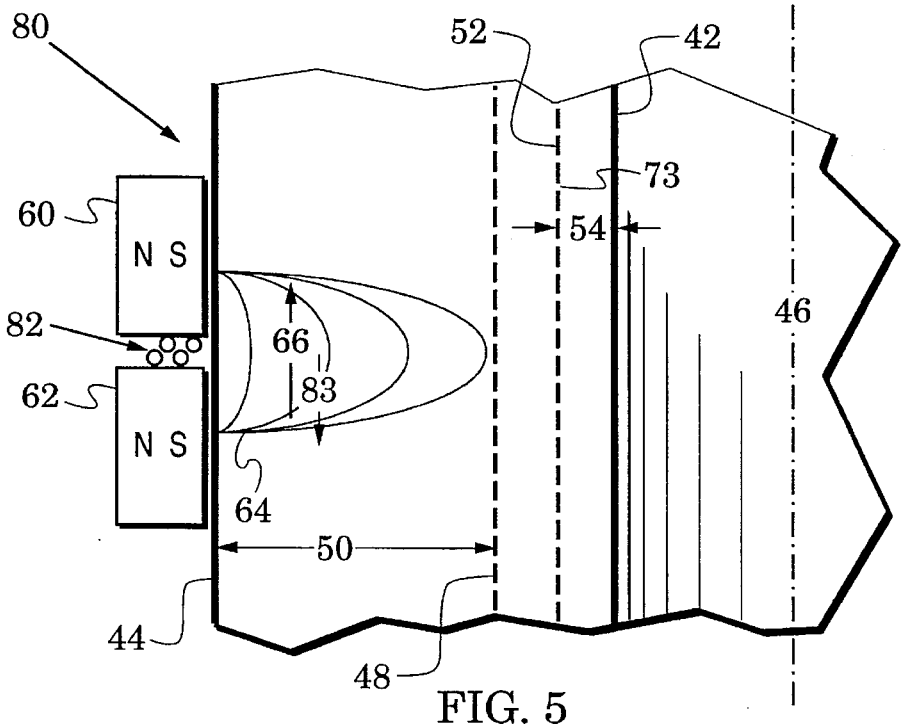
FIG. 5 is a fragmentary sectional view illustrating an off-axis portion of a low-pressure, plasma switch in accordance with the present invention.

In accordance with the present invention, FIG. 5 illustrates a low-pressure plasma switch 80 that can inhibit plasma generation during a fault condition and thereby lower the switch current into a region where its control grid can interrupt the current by electrostatic blocking. The plasma switch 80 is similar to the CMS 40 of FIG. 2, with like reference numbers indicating like elements. However, the plasma switch 80 includes a stalling coil 82 which is positioned and arranged so that a current pulse through it generates a magnetic field with an axially directed field vector 83. The axial field vector 83 is oppositely directed from the axial field vector 66 that is generated by the magnets 60, 62. As shown, an exemplary stalling coil 82 can comprise a few coil windings in a circumferential relationship with the cathode 44.

In operation, the current pulse through the stalling coil 82 is adjusted so that the field vector 83 has a lesser magnitude than the permanent field vector 66. Thus, when the stalling coil 82 is pulsed, the axial field strength in the cathode-source grid gap 50 of FIG. 5 is reduced in magnitude, i.e., a portion of the field vector 66 is canceled. The path of electrons in the gap 50 becomes more radially oriented. The reduction in path length results in diminished production of both secondary electrons and plasma. In terms of the Paschen breakdown curve 20 of FIG. 1, operation in the gap 50 has been moved to an operating position 84 that is closer to the left-hand side of the curve. Plasma generation and density are reduced so that the maximum current which the switch can supply is less than the current demand.

When the plasma generation rate does not provide sufficient plasma density to carry the circuit-demanded current, the switch 80 is said to "stall". Stalling describes the situation in which the potential distribution in the switch develops a gradient as the plasma attempts to transport charge to the anode 42.

Figure 6:
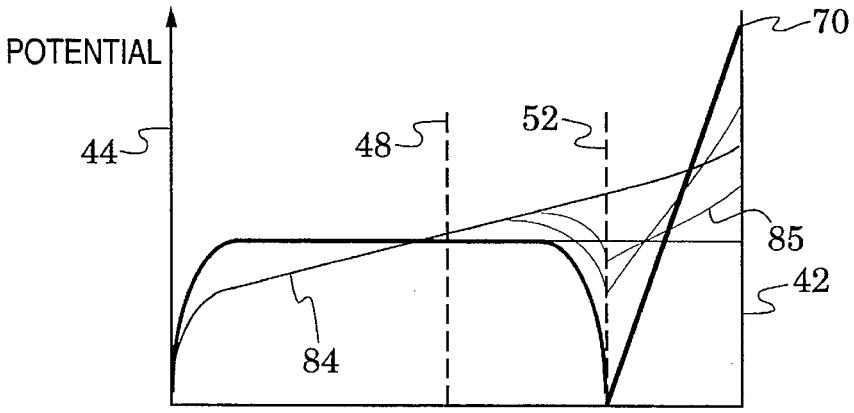
FIG. 6 is a graph that illustrates the potential distribution across the switch of FIG. 5 during a stalling condition.

This potential gradient is illustrated by the sloped potential line 84 in FIG. 6. The electric field gradient reduces the ionization rate by pulling ionizing electrons out of the discharge. It also increases the plasma-control grid potential V which causes the control grid sheath thickness to expand (78 in FIG. 4C). This situation is unstable because, as the plasma density falls, the electric field tries to pull more electrons to the anode 42, which causes the ionization to fall further. The plasma reaches an unstable equilibrium at which some ionization and plasma generation takes place but not enough to carry the fault current. In a stalled condition, the density of the plasma is reduced to a level at which it can be interrupted by elecrostatic blocking. Current interruption then returns the anode potential to the supply voltage 70 as indicated by intermediate potential lines 85. The electrostatic blocking is facilitated by the increased plasma-control grid potential that resulted from the plasma potential gradient 84.

Operation of the plasma switch 80 is similar to operation of the CMS 40 of FIG. 2 in normal conditions. However, when a system fault occurs, the stalling coil 82 is pulsed to reduce the plasma current density and create a plasma gradient, i.e., set up a stalling condition in the switch. Subsequent electrostatic pulsing of the control grid 54 then interrupts the switch current. The stalling condition can be generated in a time that is generally sufficient to prevent damage which would otherwise result from system faults, e.g., <5 microseconds. This current interruption can be compared to that of typical XFT's and CMS's. The former switch has to deplete the magnetic field throughout the entire switch volume and reduce the eddy currents in containment walls; this is a time-consuming process, e.g., >10 microseconds. The latter switch cannot interrupt currents that exceed the capability of its electrostatic blocking.

Figure 7:
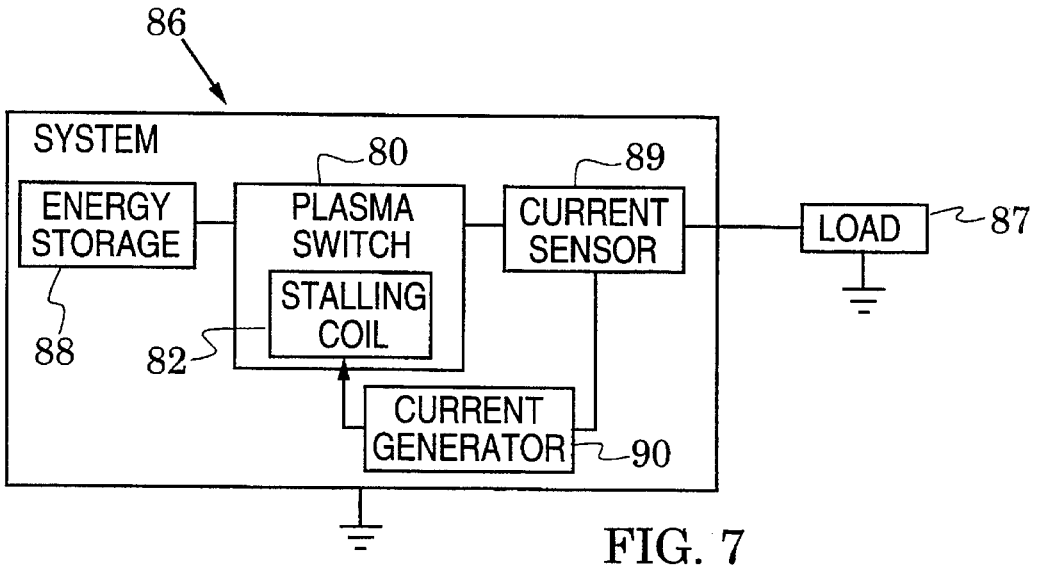
FIG. 7 is a block diagram of an exemplary system that incorporates the plasma switch of FIG. 5.

An exemplary use of the stalling coil 82 is illustrated in FIG. 7. A system 86 includes a plasma switch 80 which switches current into a load 87 from an energy storage circuit 88. A current sensor 89 is in series with the load 87 to sense overcurrent conditions. In response to the current sensor 89, a current generator 90 is arranged to pulse the stalling coil 82 of the plasma switch.

Figure 8A:
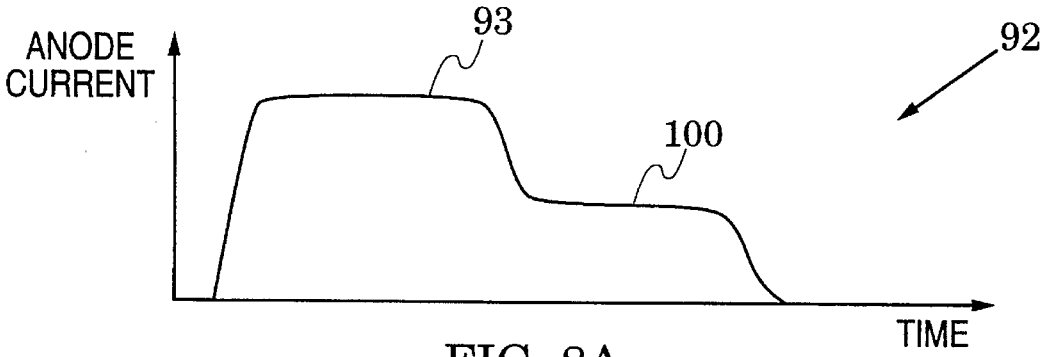
FIGS. 8A–C are repsectively graphs of anode current, axial magnetic field strength, and control grid voltage during fault operation of the system of FIG. 7.
Figure 8B:
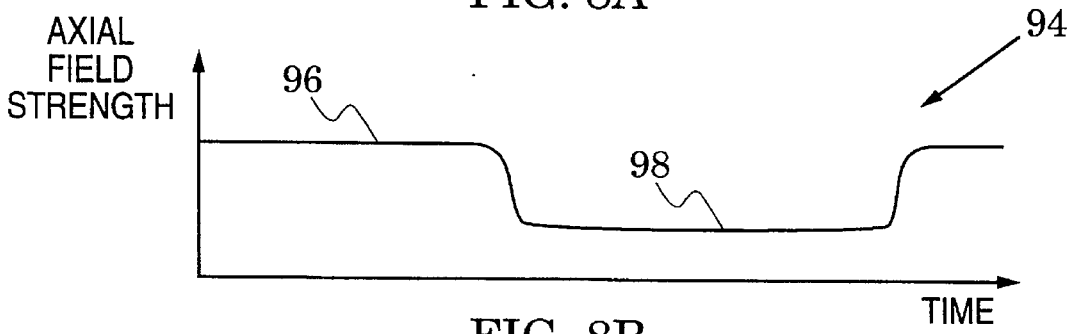
Figure 8C:
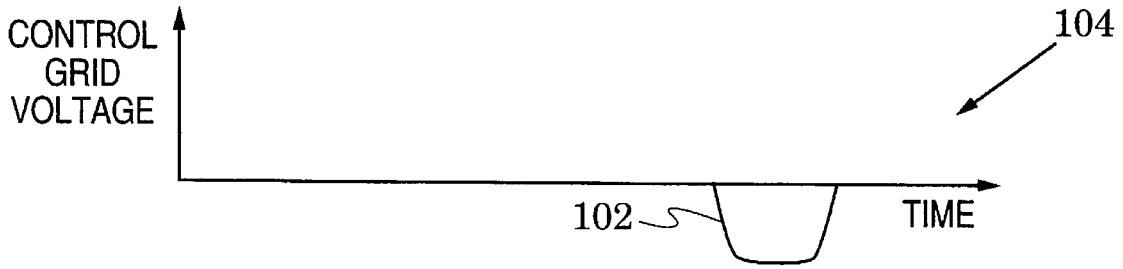

The operation of system 86 is illustrated in FIGS. 8A–8C. In the graph 92 of FIG. 8A, anode current in the switch 80 is shown to initially rise to a fault current level 93 which is too high for the switch to interrupt. In response, a stalling pulse is sent through the stalling coil 82 by the current generator 90. The stalling pulse causes a reduction of the axial magnetic field strength in the cathode-source grid gap (50 in FIG. 5).

This is indicated in the graph 94 of FIG. 8B by the field strength in the gap dropping from an initial fixed level 96 to a reduced level 98. Reduced plasma production then causes a reduction in anode current to the level 100 in FIG. 8A which is within the switch's interruptible range. A negative control grid pulse 102 can now be applied as shown in the graph 104 of FIG. 8C. Since the anode current 100 is within the interruptible current range of the control grid, the anode current is then interrupted.

To prevent damage to the load 87 (for example, a part undergoing ion implantation) the anode current must be interrupted before a significant portion of the stored energy of the system 86 is dumped. This is achieved by limiting the inductance of the stalling coil 82 so that the field vector 83 is rapidly generated. In accordance with the teachings of the invention, the inductance can be limited because the field vector 83 need only cancel a portion of the field vector 66, i.e., the magnitude of the vector 83 is much less than that of the vector 66.

For example, in an exempary ion implantation system, the system energy storage has a time constant of 10 microseconds, the strength of the fixed magnetic field is approximately 100 gauss and the anode current can be interrupted by the control grid as long as it is below 1000 amperes. When a fault occurs and the anode current increases beyond the interruption capability of the control grid, it is estimated that an opposing magnetic field of 50 gauss can bring about a stalling condition in less than 5 microseconds. The anode current can then be interrupted by electrostatic blocking before damage occurs.

Although the electrodes of the embodiment 80 are configured as coaxially arranged cylindrical elements, the teachings of the invention can be applied to other electrode arrangements, e.g., parallel plates, concentric spheres and so on. While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A plasma switch, comprising:

a plasma generator in which a first magnetic field and an electric field are oriented so that a change in said first magnetic field alters the density of a generated plasma;

a first electrode configured to sustain a voltage potential between it and said plasma generator;

a second electrode positioned between said plasma generator and said first electrode, said second electrode configured to respond to a first control signal by initiating a plasma current between said plasma generator and said first electrode and respond to a second control signal by interrupting said plasma current when it is within a predetermined range; and a magnetic field generator arranged to generate, in response to a fault signal, a second magnetic field that reduces said plasma current to said range by opposing a portion of said first magnetic field to diminish the density of said generated plasma.

2. The plasma switch of claim 1, wherein said magnetic field generator comprises a coil configured to carry an electric current in response to said fault signal.

3. The plasma switch of claim 1, wherein said plasma generator includes;

at least one magnet to produce said first magnetic field; and third and fourth spaced electrodes arranged to produce said electric field in response to a voltage potential applied across them.

4. The plasma switch of claim 1, wherein said second electrode forms a plurality of apertures to facilitate said plasma current control.

5. A plasma switch, comprising:

first and second electrodes spaced apart to establish a voltage field between them upon application of a first voltage potential across them;

a magnetic field generator arranged to form a first magnetic field that is oriented relative to said voltage field so that the density of a plasma between said first and second electrodes is a function of the strength of said first magnetic field;

a third electrode spaced from said first electrode and configured to sustain a second voltage potential relative to said first electrode;

a control electrode positioned between said third electrode and said first electrode, said control electrode configured to receive a first voltage signal to initiate the flow of a plasma current between said first and third electrodes, and to receive a second voltage signal to interrupt said plasma current when it is within a predetermined range; and a coil arranged to receive an electric current and generate a second magnetic field that is oriented to reduce said plasma current to said range by opposing a portion of said first magnetic field to diminish the density of said generated plasma.

6. The plasma switch of claim 5, wherein said control electrode forms a plurality of apertures to facilitate said plasma current control.

7. The plasma switch of claim 5, wherein said first, second, third and control electrodes are each formed to have a cylindrical portion, and said cylindrical portions are coaxially arranged.

8. A plasma switching system, comprising:

a plasma generator in which a first magnetic field and an electric field are oriented so that a change in said first magnetic field alters the density of a generated plasma;

a first electrode configured to sustain a voltage potential between it and said plasma generator;

a second electrode positioned between said plasma generator and said first electrode, said second electrode configured to respond to a first control signal by initiating a plasma current between said plasma generator and said first electrode and respond to a second control signal by interrupting said plasma current when it is within a predetermined range;

an electric current generator configured to initiate a fault current when said plasma current execeeds said predetermined threshold; and a magnetic field generator arranged to respond to said fault current by generating a second magnetic field that reduces said plasma current to said range by opposing a portion of said first magnetic field to diminish the density of said generated plasma.

9. A method of initiating and interrupting current between first and second electrodes, comprising the steps of:

forming a plasma in a region adjoining said first electrode;

positioning a control electrode between said region and said second electrode;

imposing a voltage potential across said first and second electrodes;

applying a first voltage signal to said control electrode to initiate a plasma current between said first and second electrodes;

applying a second voltage signal to said control electrode to interrupt said plasma current when it is within a predetermined range; and reducing, when said plasma current exceeds said range, the density of said plasma to bring said plasma current within said range, wherein said plasma forming step includes the step of altering the path length of electrons in an ionizable gas in said adjoining region by the application of an electric field to an existing magnetic field, and wherein said plasma density reducing step includes the step of opposing a portion of said existing magnetic field with a second magnetic field.

10. A method of initiating and interrupting current between first and second electrodes, comprising the steps of:

forming a plasma in a region adjoining said first electrode;

positioning a control electrode between said region and said second electrode;

imposing a voltage potential across said first and second electrodes;

applying a first voltage signal to said control electrode to initiate a plasma current between said first and second electrodes;

applying a second voltage signal to said control electrode to interrupt said plasma current when it is within a predetermined range; and reducing, when said plasma current exceeds said range, the density of said plasma to bring said plasma current within said range, and further including the step of sensing when said plasma current exceeds said predetermined range, and wherein said plasma density reducing step includes the step of responding to said sensing step.

11. A method of initiating and interrupting current in a plasma switch, comprising the steps of:

orienting a first magnetic field and a first electric field to generate a plasma whose density is a function of the strength of said first magnetic field;

establishing a second electric field across said plasma with a pair of electrodes;

initiating a plasma current between said pair of electrodes by applying a first voltage signal to a control electrode;

interrupting said plasma current when it is within a predetermined range by applying a second voltage signal to said control electrode; and reducing said plasma current, when it exceeds said range, to said range with a second magnetic field oriented to cancel a portion of said first magnetic field.

12. The method of claim 11, further including the step of sensing when said plasma current execeeds said predetermined range, and wherein said plasma current reducing step includes the step of responding to said sensing step.

* * * * *